US005798060A

United States Patent [19]

Brevett

[11] Patent Number: 5,798,060

[45] Date of Patent: Aug. 25, 1998

[54] STATIC-DISSIPATIVE POLYMERIC COMPOSITION

[75] Inventor: Carol Annona Simmons Brevett, Bear, Del.

[73] Assignee: E. I. du Pont de Nemours and Company, Wilmington, Del.

[21] Appl. No.: 796,766

[22] Filed: Feb. 6, 1997

[51] Int. Cl.[6] ..... H01B 1/20

[52] U.S. Cl. ..... 252/520.1; 252/519.33; 106/1.22; 524/910

[58] Field of Search ..... 252/511, 512, 252/513, 514, 520.1, 519.33; 106/1.12, 1.22; 428/922; 524/910, 911, 912

[56] References Cited

U.S. PATENT DOCUMENTS

| | | | |
|---|---|---|---|
| 4,373,013 | 2/1983 | Yoshizumi | 428/570 |
| 4,452,830 | 6/1984 | Yoshizumi | 427/215 |
| 4,568,609 | 2/1986 | Sato et al. | 428/403 |
| 4,655,966 | 4/1987 | Guillaumon et al. | 252/518 |
| 4,880,703 | 11/1989 | Sakamoto et al. | 428/378 |
| 5,071,676 | 12/1991 | Jacobson | 427/214 |
| 5,091,229 | 2/1992 | Golike et al. | 428/35.2 |
| 5,114,756 | 5/1992 | Mirabeau et al. | 427/379 |
| 5,236,737 | 8/1993 | Linton | 252/518 |
| 5,273,822 | 12/1993 | Hayashi et al. | 428/389 |
| 5,284,705 | 2/1994 | Cahill | 428/328 |
| 5,292,551 | 3/1994 | Jacobson | 252/518 |
| 5,296,168 | 3/1994 | Jacobson | 252/518 |
| 5,364,566 | 11/1994 | Jacobson | 252/518 |
| 5,476,613 | 12/1995 | Jacobson | 252/518 |
| 5,545,250 | 8/1996 | Bergmann et al. | 75/252 |
| 5,585,037 | 12/1996 | Linton | 252/518 |

FOREIGN PATENT DOCUMENTS

| | | |
|---|---|---|
| 245 647 A1 | 5/1987 | Germany . |
| 63-046258-A | 2/1988 | Japan . |
| 01172224-A | 7/1989 | Japan . |
| 03193970-A | 8/1991 | Japan . |
| 03241067-A | 10/1991 | Japan . |
| 04077317-A | 3/1992 | Japan . |
| 04153317-A | 5/1992 | Japan . |
| 07048463-A | 2/1995 | Japan . |

*Primary Examiner*—Mark Kopec

[57] ABSTRACT

A static dissipative polymeric composition comprising a polymer matrix having a substantially uniform distribution therein of at least two fillers, wherein at least one filler comprises electroconductive particles and at least one filler comprises non-electroconductive particles is disclosed.

10 Claims, 2 Drawing Sheets

COMPOSITION BY VOLUME

COMPOSITION BY VOLUME

COMPOSITION BY WEIGHT

STATIC-DISSIPATIVE POLYMERIC COMPOSITION

FIELD OF THE INVENTION

This invention relates to a static dissipative polymeric composition comprising a polymer matrix containing an intimate substantially uniform distribution of at least two fillers, wherein at least one filler is electroconductive and at least one filler is non-electroconductive.

BACKGROUND OF THE INVENTION

Electroconductive powders are used to make polymeric materials electrically conductive. A particularly useful aspect of this is that a conductive surface effectively dissipates static electrical charge which otherwise builds up on the surface of many polymers. Resistance to static electrical charge build up resulting in subsequent discharge is a very desirable property for many polymeric materials. For example, it is desirable in packaging film for sensitive electronic components or assemblies to protect them from damage due to electrostatic discharge, electrostatic field force and radio frequency interference.

The surface of non-conductive compositions is commonly made static dissipative by applying a coating on fabricated polymeric articles. This has several disadvantages. Additional processing adds to cost, and effective life depends on the durability of the coating.

The use of electroconductive powders comprising particles of a silica-containing material coated on the surface with a two-dimensional network of antimony-containing tin oxide ($Sb\text{-}SnO_2$) crystallites is known to provide a flexible static charge-dissipating polymer structure. Such powders are used to provide an electrostatic dissipative coating on the inside of paperboard or paper containers. Electroconductive powders which incorporate $Sb\text{-}SnO_2$ crystallites, have important advantages over other types of powder used for this purpose. Carbon black imparts dark color and causes undesirable heating due to infrared energy absorption. Polymeric quaternary ammonium salts are adversely affected by humidity.

U.S. Pat. No. 5,284,705 describes an anti-static coating composition consisting essentially of a pigment portion dispersed in a binder portion. The binder portion contains a curable film-forming binder, the pigment portion contains tin oxide-rich electrically-conductive pigment blended with an electrical conductivity-enhancing proportion of a hard impalpable achromatic filler mineral. The filler has a hardness of at least 7 Mho and a particle size up to about 44 microns. The mixtures incorporated in polymer products, such as plastics, lacquers or printing inks, result in better electrical properties than are obtained by using the individual pigment components in similar amounts. U.S. Pat. No. 5,545,250 relates to mixtures of electroconductive powders having $Sb\text{-}SnO_2$ as the electroconducting phase which, when incorporated into polymer systems, give higher surface electroconductivity than is obtained using the individual component powders at equivalent loadings of $Sb\text{-}SnO_2$.

Enhancement of the effectiveness of $Sb\text{-}SnO_2$ based compositions for making the surface of polymeric materials static-dissipative is desirable. The present invention comprises a polymer based composition incorporating a mixture of non-electroconductive and electroconductive fillers which has a higher static-dissipative capacity than expected based on the $Sb\text{-}SnO_2$ loading of the polymer composition. In the polymeric compositions of this invention the electroconductive filler and non-electroconductive filler components are distributed throughout the polymer matrix in the polymer fabrication step. No surface coating is employed. Thus in addition to the surface having static-dissipative properties the bulk composition is electroconductive. Suitable non-electroconductive fillers are readily available at considerably less cost than electroconductive fillers, thus providing a very significant economic advantage.

SUMMARY OF THE INVENTION

The present invention comprises a static-dissipative polymeric composition comprising a polymer matrix having substantially uniform distribution of at least two particulate fillers, wherein at least one filler comprises electroconductive particles and at least one filler comprises non-electroconductive particles. The composition is in the form of a film, coating, sheet, fiber, bulk component, or molding and casting granules which can be used in the fabrication of the aforesaid forms of articles. The preferred component in said electroconductive filler is $X\text{-}SnO_2$ wherein X is Sb, Ta, P, In, Al, Mo, W or halogen. The percentage of X as a fraction of $X\text{-}SnO_2$ is from about 0.01% to about 50%, preferably 0.01% to 10%. Other suitable electroconductive fillers are halogen doped titanium oxide and antimony, or aluminum-doped zinc oxide. The non-electroconductive filler comprises inert particles having at least one dimension in the size range of from about 30 to about 2000 microns.

DETAILED DESCRIPTION OF THE INVENTION

The present invention comprises a static dissipative polymeric composition comprising a matrix of a polymer or mixture of polymers having substantially uniform distribution therein of at least two particulate fillers, wherein at least one filler comprises electroconductive particles and at least one filler comprises non-electroconductive particles. The composition is in the form of a film, coating, sheet, fiber, or bulk component, or in the form of molding and casting granules which are used in the fabrication of the aforesaid forms. It is useful wherever it is necessary to avoid build up of surface electrical charge on polymeric materials. In the polymeric compositions of this invention the electroconductive filler and non-electroconductive filler components are distributed throughout the polymer matrix during polymer fabrication and in addition to the surface being static-dissipative the bulk composition is electroconductive.

Figure 1:
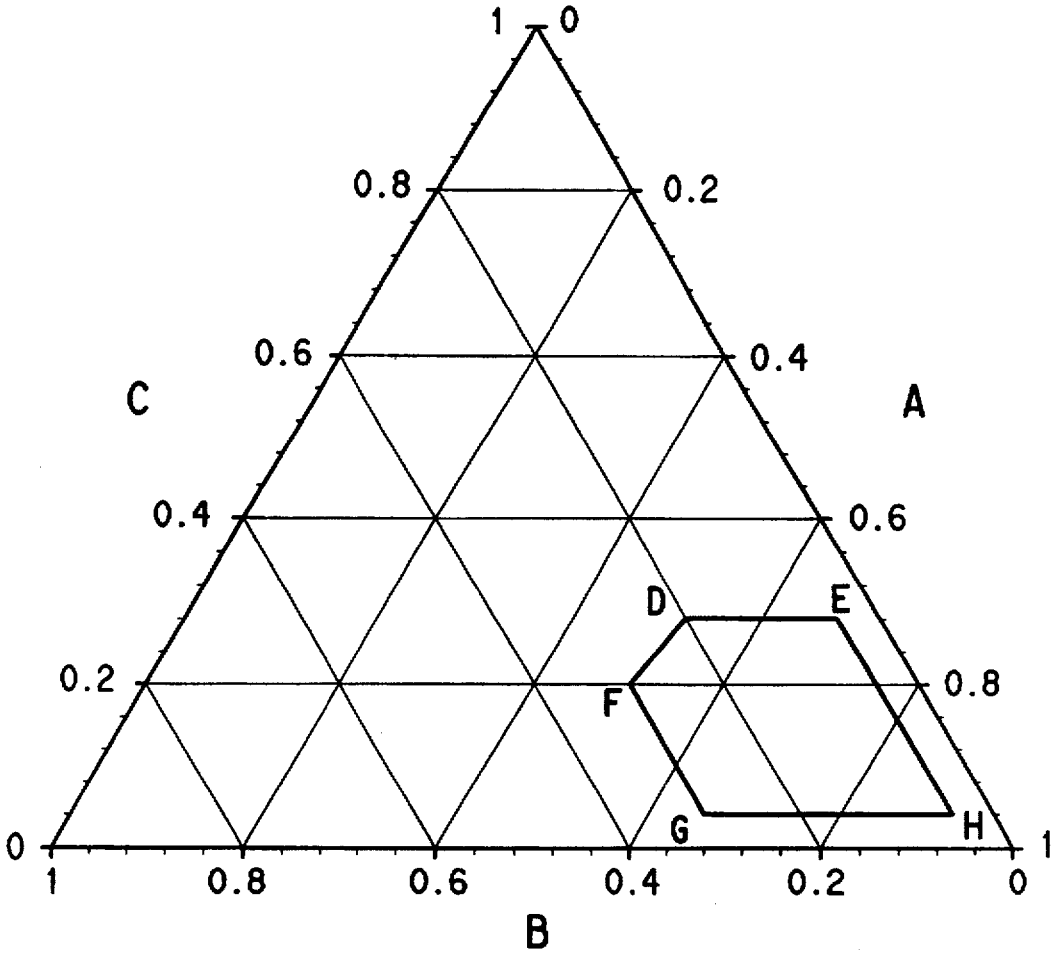
FIG. 1 is a graphical representation of the proportions by volume of the three types of components of the compositions of the present invention, i.e., polymer (A), electroconductive filler (B) and non-electroconductive filler (C). A composition of the present invention is within the area DEFGH.
Figure 2:
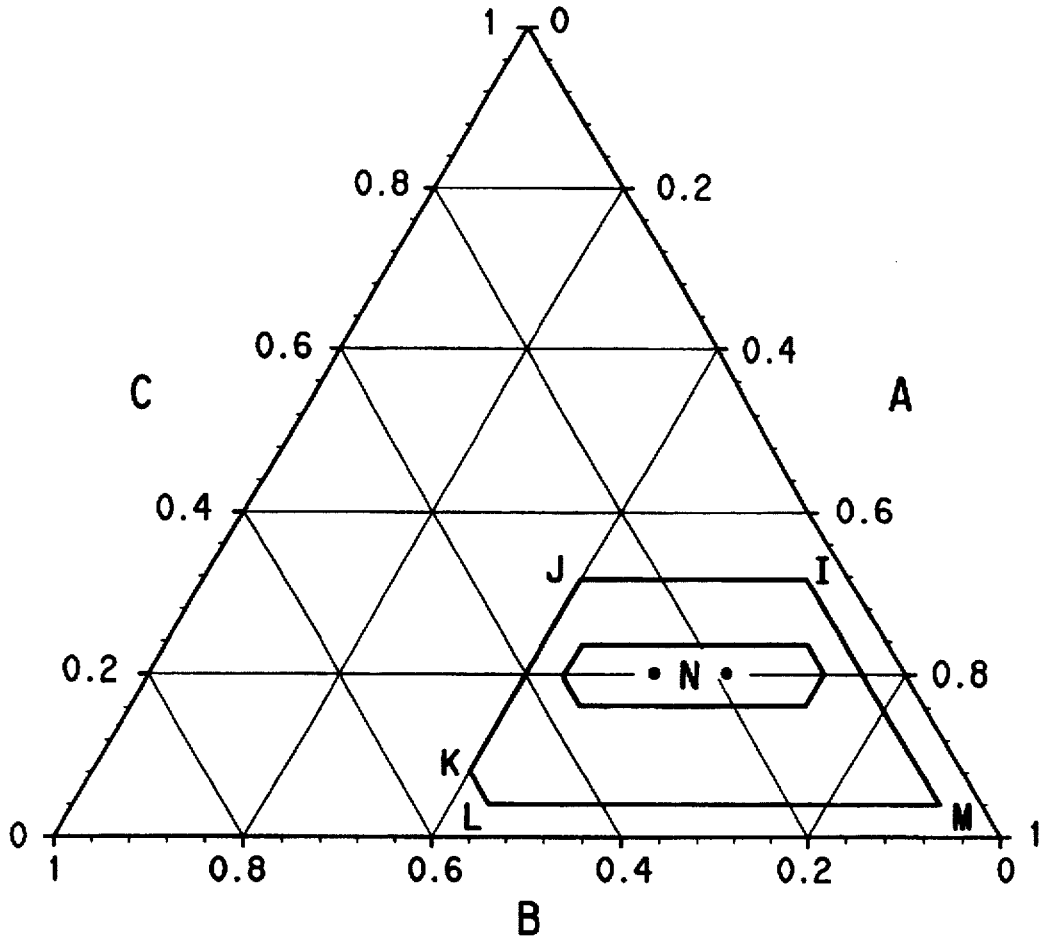
FIG. 2 is a graphical representation of the proportions by weight of the three types of components of the compositions of the present invention, i.e., polymer (A), electroconductive filler (B), and non-electroconductive filler (C). A composition of the present invention is within the area IJKLM.

The proportions of the three types of components, polymer, electroconductive filler and non-electroconductive filler which comprise the static-dissipative polymer composition are shown graphically in FIG. 1, wherein a composition of the invention is within the area designated DEFGH. This corresponds on a volume basis to a range of polymer content from about 50% to about 95%, a range of electroconductive filler content from about 5% to about 30% and a range of non-electroconductive filler content from about 5% to about 30%, said percentages totaling 100% for any particular composition of the invention. On a weight basis a composition of the present invention is shown graphically in FIG. 2, wherein a composition of the present invention is within the area designated IJKLM. Preferred compositions are within the area designated N. The compositions of the present invention on a weight basis comprise from about 40% to about 90% polymer, from about 5% to about 50% electroconductive filler and from about 5% to about 30% non-electroconductive filler, said percentages totaling 100% for any particular composition of the invention. On a weight basis the most preferred composition, which has the highest static dissipativity relative to the amount of electroconductive filler used, comprises from about 55% to about 65% polymer, from about 15% to about 25% electroconductive filler and from about 15% to about 25% non-electroconductive filler.

Electroconductive fillers used in the compositions of this invention have doped tin oxide as the conductive component. When the electroconductive fillers are intimately and uniformly distributed together with appropriate non-electroconductive fillers throughout a polymer matrix an unexpected increase in static-dissipativity occurs, the static-dissipativity being considerably greater than would be expected based on the amount of electroconductive filler present. The improvement in electroconductivity which is obtained by incorporating such non-electroconductive fillers enables a similar level of electroconductivity to be obtained using about 30 to 40% less of the electroconductive filler. The non-electroconductive fillers are relatively inexpensive and consequently the cost effectiveness of the electroconductive fillers in static-dissipative polymeric compositions is significantly improved.

Both thermoplastic and thermosetting resins are suitable for use herein as the polymer matrix, with thermoplastics being preferred. Suitable resins are amenable to extrusion, melt processing and injection molding. The final products range from flexible to stiff. Mixtures or blends of two or more compatible polymer resins can also be used as the polymer matrix in the compositions of the invention. The polymer resins are homopolymers, copolymers or block polymers of the following: acetals [DELRIN], acrylic esters, methacrylic esters, vinyl esters, vinyl chloride, vinyl ethers, acrylonitrile, styrene-acrylonitrile, acrylonitrile-butadiene-styrene, amides [NYLON], styrene maleic anhydride, ethylene methacrylic acid, carbonates, ester-elastomers, polyether-ester block copolymer [HYTREL], olefins, ethylene, propylene, butylene, polyethylene terephthalate, polyethylene terephthalate glycol, ionomer resins, [SURLYN and NUCREL], butadiene, polybutylene terephthalate [RYNITE and CRASTIN], styrene, butadiene, sulfones, ether aryl sulfones, ester urethanes, ether urethanes, [ESTANE thermoplastic grades], chain extended polyoxiranes [STAT-RITE] and blends of [STAT-RITE] with the above.

The preferred resins are polyesters and polyether-ester block copolymer [HYTREL]; polyolefins, such as polyethylene and polypropylene, polybutylene, and their copolymers, such as polyolefin terephthalates such as polyethylene terephthalate, polyethylene terephthalate glycol, polybutylene terephthalate [RYNITE and CRASTIN], ethylene methacrylic acid copolymers, ionomer resins, [SURLYN and NUCREL], ester urethanes, ether urethanes [ESTANE], and chain extended polyiroxanes [STAT-RITE], with the most preferred resins being polyether-ester block copolymers [HYTREL], and ionomers [NUCREL] which are particularly useful for making packaging films.

Suitable electroconductive fillers are powders in which the electroconducting component is crystals or powders of X-$SnO_2$ wherein X is Sb, Ta, P, In, Al, Mo, W or halogen. Preferred halogens are F or Cl. The percentage of X as a fraction of X-$SnO_2$ is from about 0.01% to about 50%, preferably from about 0.01% to about 10%. Other suitable electroconductive fillers are halogen-doped titanium oxide and antimony or aluminum-doped zinc. Preferred are Sb-$SnO_2$ compositions because they are very effective and readily available. These include for example; ZELEC ECP-XC and ECP-3010-XC, both available from E.I. du Pont de Nemours and Company, Wilmington, Del.; STANOSTAT series, available from MEI - Magnesium Elecktron, Flemington, N.J.; Sb-$SnO_2$ T-1 grade available from Mitsubishi, Saitama, Japan; and Tego Conduct S or Tego Conduct Ultra from Th. Goldschmidt Essen, F. R. Germany.

The Sb-$SnO_2$ crystallites alternatively are also uniformly distributed with silica. Also suitable are compositions in which two dimensional networks of Sb-$SnO_2$ crystallites provide a conductive outer shell on an inert particle core, such as $TiO_2$. Commercially available examples include ZELEC ECP-T and ECP-1410-T available from E. I. du Pont de Nemours and Company, Wilmington, Del.; Mitsubishi's W-1 grade available from Mitsubishi, Saitama, Japan; and Ishihara's FT-1000 and FT-2000 grades available from Ishihara, Osaka, Japan; the latter using acicular $TiO_2$. Also an outer shell of Sb-$SnO_2$ on a mica core is suitable for use herein such as ZELEC ECP-M and ECP-1410-M available from E. I. du Pont de Nemours and Company, Wilmington, Del., and MINATEC available from E. Merck, Darmstadt, F. R. Germany; or an outer shell of Sb-$SnO_2$ on a hollow silica sphere core, for example ZELEC ECP-S and ECP-1610-S available from E. I. du Pont de Nemours and Company, Wilmington, Del.

Other suitable electroconductive filler compositions comprising a core particle coated with Sb-$SnO_2$ crystallites utilize as the core oxides of magnesium, calcium, barium, strontium, zinc, tin, nickel and iron; carbonates and sulfates of calcium, barium, strontium; aluminum borate, potassium titanate, inorganic silicates, clays, asbestos, cordierite, anorthite and pyrophyllite among others. Alternatively the core particles are also coated with amorphous silica prior to coating with Sb-$SnO_2$ crystallites. Some examples of available compositions are E. Merck's, Darmstadt, F. R. Germany; Sb-$SnO_2$ on barium sulfate and Otsuka's, Tokushima, Japan; Dental WB-200 and WB-300 which are Sb-$SnO_2$ on fibrous potassium titanate (FYBEX).

Suitable non-electroconductive fillers for use in the present invention include glass rods, hollow glass spheres, glass spheres, wollastonite, cordierite, anorthite, mineral wool (INORPHIL) pyrophyllite and calcium sulfate fibers. The non-electroconductive fillers preferably have a Mho hardness less than about 7, more preferably less than about 6. The degree of improvement in the surface electrical conductivity of a polymeric composition of the invention, when a non-electroconductive filler is incorporated together with an electroconductive filler, is a function of the size and shape of the non-electroconductive filler. Particle size is important and in order to achieve a desirable degree of improvement particles have at least one dimension greater than about 30 microns (micrometers), preferably greater than about 45 microns. The effectiveness of a filler is less if the particles become too large and the maximum size may be limited by the thickness of the final plastic article. Wollastonite rods up to 350 microns long are found to be very effective in a molded polyether-ester (HYTREL) sheet 1 to 2 mm thick. Depending upon the thickness, of the polymeric article the upper size limit for non-electroconductive filler particles is about 2000 microns. With respect to particle shape, rods and fibers are found to be more effective than spheres. It is preferred that the aspect ratio is at least 10:1 length to diameter. Examples of very effective non-electroconductive filler are Wollastonite rods, size 100 to 350 microns, aspect ratio 15:1, NYAD G available from Nyco Minerals Inc., Willsboro, N.Y.; calcium sulfate fibers, size 50 to 60 microns, aspect ratio 30:1, FRANKLIN FIBER A30 available from U.S. Gypsum Co., East Chicago, Ind.; glass spheres, size 50 microns SPHERIGLASS A2900 available from Potters Industries Inc., Parsippany, N.J.; INOR-PHIL mineral wool, grade 064-10 manufactured by Laxa Bruk, Sweden and available from Akzo Nobel, Stratford, Conn. By contrast titanium dioxide, grade R-700 (0.4 microns) available from E. I. du Pont de Nemours and Company, Wilmington, Del. and glass spheres size 4 microns, SPHERIGLASS A6000, are ineffective.

A static dissipative polymeric composition of the present invention also contains as an optional component one or more conventional polymer resin compounding ingredients such as organic or inorganic fillers, reinforcing agents, coupling agents, colorants, antioxidants, plasticizers, ultraviolet stabilizers, lubricants, antifogging agents, flame retarding agents, foaming agents, mold release agents, curing agents, crosslinking agents and other similar agents provided they do not adversely affect the static-dissipative character of the composition.

The components of the composition of the present invention, (polymer feedstock, fillers and compounding ingredients) are usually in granular or particulate form. In order to achieve the intimate mixing and uniform distribution of the components which are required in order to maximize the surface electroconductivity, intensive mixing procedures are used. By "substantially uniform distribution" is meant that the components are essentially homogenously mixed such that there are no segregated areas of individual components. Premixing of the required amounts of components using non-intensive mixers may be done but is not essential. This can be accomplished using drum tumblers, double-cone blenders, V-blenders and ribbon blenders. More thorough mixing is accomplished in equipment employing mixing shafts which are used in a wide variety of units known by the name of the inventor or the manufacturer. Such mixers include the Forsberg, the Marion, the Littleford, the Day and the Willow Tech among others. Their essential features are two shafts with overlapping mixing plows. Another suitable similar mixer is the sigma-blade mixer. For the final compounding stage intensive fluxing mixers are employed, such as a Banbury mixer, which is widely used in rubber compounding, or a Haake twin screw mixer or mixers which incorporate a kneading action such as the Buss-Kneader and the Baker Perkins Ko-Kneader. A more complete account of compounding procedures is given in 1st Ed., 1986, Vol.4, pp.66–78, Encyclopedia of Polymer Science, published by John Wiley & Sons.

The compounded composition is fabricated to give the required shape and dimensions using conventional procedures for plastic compositions. These include, but are not limited to, extrusion, blow molding, compression molding, calendering, injection molding and extrusion.

The dissipation of surface electric charge on the surface of a polymeric composition is a function of the surface electrical conductivity. The higher the surface electrical conductivity, the more effectively a surface charge is dissipated. Surface electrical conductivity is inversely related to surface electrical resistivity which can readily be measured. The evaluation of a polymeric composition is conducted by first feeding the components in the required proportions to a Haake screw mixer and compounding them at a temperature and screw speed and time appropriate for the polymer or polymers being processed. The compounded mixture is then compression molded at a temperature appropriate for the composition using a 0.16 cm (1/16 inch) chase to form a plastic test sheet having a thickness of about 0.16 cm (62 mils). The surface electrical conductivity is measured at ambient conditions using a Model 262A surface meter available from Monroe Electronics Inc. Lydonville, N.Y. This instrument gives a direct reading in ohms per square; the voltage is fixed at 100 volts. For a non-conducting or insulating surface the surface electrical conductivity is of the order of $10^{13}$ ohms per square or greater. It is convenient to express the surface electrical conductivity as its logarithm, i.e. for surface electrical conductivity $10^{13}$, Log surface electrical conductivity is 13. A very highly conductive surface has a surface electrical conductivity of about $10^3$ or Log surface electrical conductivity of 3. For a surface to have acceptable static-dissipative capability the Log surface electrical conductivity is in the range of from about 5 to about 12, preferably from about 6 to about 9.

The compositions of the present invention enable Log surface electrical conductivity values in this range to be obtained using significantly smaller amounts of electroconductive filler than would be the case if the non-electroconductive filler component were not incorporated in the composition.

The surface of non-conductive compositions is commonly made static dissipative by applying a coating to the surface. In the case of the polymeric compositions of this invention the electroconductive filler and non-electroconductive filler components are intimately and substantially uniformly distributed throughout the polymer matrix. Consequently the compositions of this invention are electroconductive. Electroconductive polymers are classified and have commercial applications based on their volume resistivity which is measured both as in-plane volume electrical resistance (IPVER) and through-plane volume electrical resistance (TPVER). Volume resistivities are determined by the procedures of ASTM method D 257. In-plane volume electrical resistance is determined using a Keithley Model 247 voltage regulated power supply and measuring the current (milliamps) with a Keithley 617 programmable Electrometer, available from Keithley Instruments Inc., Cleveland, Ohio. In-plane volume electrical resistance is calculated in ohms/cm and, as in the case of surface electrical conductivity, it is conveniently expressed as a logarithm. Through-plane volume electrical resistance is determined using a Monroe Electronics Model 278 resistance/current meter, set at 100 volts, with a Model 96117-1 probe. Through-plane volume electrical resistance is calculated in ohms/cm from the resistance reading, sample thickness and electrode geometry. It is conveniently express as a logarithm. All of the resistivities reported were measured at 100 volts, ambient temperature (about 23° C.) and ambient relative humidity. However the static-dissipative materials generally dissipate over the range of 1 to 500 volts.

Functional failures or problems in modern electronics components are often due to damage caused by electrostatic discharge and electrostatic field force they may experience during shipping. It is important that electrostatic charge should not build up on the surface of plastic packaging films and containers subjecting the contents of packages to damage from electric discharge. The surface of non-conductive compositions is commonly made static dissipative by applying a coating to fabricated polymeric articles. This has disadvantages since additional processing adds to cost and effective life depends on the durability of the coating. The static dissipative polymeric compositions of the present invention are useful in formulating fabricated polymeric articles, such as packaging films and containers. The fillers are distributed throughout the polymer matrix and render the articles static dissipative.

EXAMPLE 1

The following components were fed to a Haake 60 cc. twin screw mixer and compounded at a melt set point of 264° C. and 100 rpm for a total of 11 minutes. 51 g of a polyether-ester block copolymer made from polybutylene terephthlate and polyether glycols (HYTREL 7246 high modulus molding and extrusion grade pellets containing color stable antioxidants), supplied by E. I. du Pont de Nemours and Company, Wilmington, Del., 27 g of an electroconductive powder (ECP-1410-T, antimony-doped tin oxide coated titanium dioxide particles) supplied by E. I. du Pont de Nemours and Company, Wilmington, Del., and 21 g of soda-lime glass spheres (Spheriglass A2900, mean particle size 49 microns) supplied by Potters Industries Inc., Parsipanny, N.J. The compounded mixture was compression molded at 240° C. using a 0.16 cm (1/16 inch) chase to form a plastic sheet with a thickness of 1.57 mm (62 mils).

Surface electrical resistivity of the molded sheet measured using a Model 262A surface resistivity meter supplied by Monroe Electronics Inc., Lyndonville, N.Y., was found to be $10^7$ ohms/square, corresponding to a Log surface electrical conductivity of 7. The surface had excellent conductivity to effectively dissipate surface static charge.

Through-plane volume electrical resistivity (TPVER) of the molded sheet, measured using a Monroe Electronics Inc. Model 278 resistance/current meter set at 100 volts and a Model 96117-1 probe, was $10^9$ ohms/cm or a Log TPVER of 9. The polymer showed very good bulk conductivity.

COMPARATIVE EXAMPLE A

This comparative example was conducted as described in Example 1 with the difference that a non-electroconductive component was not used. 50.5 g of HYTREL 7246 pellets and 21.7 g of ECP-1410-T powder were compounded and compression molded using a 240° C. melt set point and 150 rpm for a total of 5 minutes. The ECP-1410-T component was 30% by weight of the composition compared with 27.3% by weight in Example 1 which contained glass spheres in addition. Even though the proportion of electroconductive filler in the composition was higher the surface electrical resistivity of the molded sheet, measured as above, was $10^{12}$ ohms/square, corresponding to a Log surface electrical conductivity of 12.

The surface conductivity of this composition was much lower than that of the composition made in Example 1 and it was not static-dissipative. The difference between the compositions of Example 1 and Comparative Example A clearly demonstrated that more efficient utilization of the electroconductive filler occurred when a non-electroconductive filler was incorporated.

EXAMPLES 2–4, COMPARATIVE EXAMPLES B-F

In the compositions of these examples the polymer was a polyether-ester block copolymer (HYTREL 7246), the electroconductive filler was an electroconductive powder, antimony-doped tin oxide coated titanium dioxide particles (ECP-1410-T), both available from E. I. du Pont de Nemours and Company, Wilmington, Del., and the non-electroconductive filler was as shown in Table 1. These three components were compounded in the ratio by weight of 51/27/21 of polymer/electroconductive filler/non-electroconductive filler, and compression molded to yield test sheets as in Example 1. In Examples 2 through 4 the non-electroconductive filler compositions were within the present invention. The other non-electroconductive fillers used in Comparative Examples B through F were not within the present invention.

The surface electrical resistivity of molded test sheets was measured as in Example 1 and the corresponding Log surface electrical conductivity values are shown in Table 2. The Log surface electrical conductivity for the compositions of Examples 2 to 4 was 6 to 7, while in the case of the compositions of Examples B to F they ranged from 9.5 to 14. The compositions of the present invention more effectively dissipated surface static charge than the comparative examples.

The through-plane volume electrical resistivity (TPVER) of the molded test sheets of Examples 2, 3, and 4 was measured, as described in Example 1. Log TPVER values were 7.1, 7.6 and 9 respectively (Table 2). The in-plane volume electrical resistivity (IPVER) of the molded test sheets of Examples 2, 3, 4, B and C was measured using a Keithley Instruments Inc. Model 247 voltage regulated supply and a Model 617 programmable electrometer. The compositions in which the non-electroconductive filler was $CaSO_4$ microfiber and Wollastonite rod (Examples 2 and 3) had low values for the Log IPVER, 4.5 and 7 respectively, corresponding to very good bulk conductivity. This conductivity was considerably better than the compositions containing INORPHIL rod (mineral wool) and SPHERICEL glass spheres (Examples B and C) which had an IPVER of 12 and 13 respectively (Table 2).

TABLE 1

| Example Number | NEF* Type | Shape | Percent Volume | Size, Microns | Aspect Ratio Length/Diameter |
|---|---|---|---|---|---|
| 2 | FRANKLIN FIBER A30 ($CaSO_4$ microfiber) | rod | 13 | 50 to 60 | 30:1 |
| 3 | NYADG(Wollastonite) | rod | 13 | 100 to 350 | 15:1 |
| 4 | INORPHIL 064-10 (Mineral Wool) | rod | 11 | d50** = 140 | |
| B | SPHERICEL 110P8 (Glass) | hollow sphere | 29 | d50 = 8 | |
| C | $TiO_2$ R700 | sphere | 10 | d50 = 0.3 | |
| D | GLASS A6000 | sphere | 15 | d50 = 3.7 | |
| E | MICA WW GM-25 | plate | 11 | Face ca.25 | |
| F | MICA | plate | 29 | Face ca 10 | |

*NEF = non-electroconductive filler
*d50 = mean spherical equivalent particle diameter Sources of Non-electroconducting Fillers FRANKLIN FIBER A30, U.S. Gypsum Co., East Chicago, Ind.

NYAD G(Wollastonite) Nyco Minerals Inc., Willsboro, N.Y.

INORPHIL 64-10 Akzo Nobel, Stratford, Conn.

SPHERICEL 110 P8 Potters Industries Inc., Parsipanny, N.J.

$TiO_2$ R700 E.I. du Pont de Nemours and Company, Wilmington, Del.

GLASS A6000 Potters Industries Inc., Parsipanny, N.J.

MICA WW GM-25 Franklin Minerals, Hartwell, Ga.

MICA Franklin Minerals, Hartwell, Ga.

TABLE 2

| Example Number | Log SER | Log TPVER | Log IPVER |
|---|---|---|---|
| 2 | 5.5 | 7.1 | 4.5 |
| 3 | 6 | 7.6 | 7 |
| 4 | 7 | 9 | 12 |
| B | 9.5 | NM | 13 |
| C | 12.5 | NM | NM |
| D | 12 | NM | NM |
| E | 14 | NM | NM |
| F | 13 | NM | NM |

NM=Not Measured

Log SER=Logarithm of Surface Electrical Resistance

Log TPVER=Log of Through-Plane Volume Electrical Resistivity

Log IPVER=Log of In-Plane Volume Electrical Resistivity

EXAMPLE 5

The procedure described in Example 1 was conducted except that a different grade of polyether-ester block copolymer, HYTREL 5526 (a medium modulus molding grade containing color stable antioxidants) supplied by E. I. du Pont de Nemours and Company, Wilmington., Del., and a different non-electroconductive filler, INORPHIL 064-10 mineral wool available from Akzo Nobel, Stratford, Conn., were used. Also the melt set point was slightly lower, 257° C. A sheet molded as in Example 1 was found to have a Log SER=7, the same as that measured in Example 1. The Log TPVER=8 compared with 9 for the composition of Example 1. The Log IPVER=7.5, also very similar to Example 1.

COMPARATIVE EXAMPLE G

This comparative example was conducted as described in Example 5 with the difference that a smaller particle non-electroconductive filler $TiO_2$ R-700 available from E. I. du Pont de Nemours and Company, Wilmington, Del., was used instead of INORPHIL 064-10 and the melt set point was 254° C. The Log surface electrical conductivity of a sheet molded as in Example 1 was 14. This composition was not static dissipative whereas the composition of Example 5, which contained a larger rod like non-electroconductive filler (INORPHIL 064-10) was very effective in dissipating surface static charge.

EXAMPLES 6–7, COMPARATIVE EXAMPLES H-I

The procedure used in these examples was the same as that described in Example 5 with the only change being that different non-electroconductive fillers were used as shown in Table 3. The three components were compounded in the ratio by weight of 51/27/21 polymer/electroconductive filler/non-electroconductive filler, and compression molded to form test sheets as described in Example 1 for which the surface electrical conductivity was measured as in Example 1. The results are summarized in Table 4. In Examples 6 and 7 the non-electroconductive filler compositions used were within the present invention and the Log surface electrical conductivity results were 5.5 and 5.6, respectively. This corresponded to a surface conductivity that results in very effective dissipation of surface static charge. The non-electroconductive filler compositions used in Examples H and I were not within the present invention and the Log surface electrical conductivity values were 12 and 11, respectively. The surfaces of these compositions were not static dissipative.

For Examples 6 and 7 the Log TPVER values were both 7.5 and the Log IPVER values were 5.3 and 5.4, respectively, indicative of excellent conductivity for both compositions.

TABLE 3

| | NEF* | | | Aspect Ratio |
|---|---|---|---|---|
| Example Number | Type | Shape | Size, Microns | Length/ Diameter |
| 6 | GLASS A2900 | sphere | d50** = 49 | |
| 7 | NYADG (Wollastonite) | rod | 100 to 350 | 15:1 |
| H | GLASS A6000 | sphere | d50** = 3.7 | |
| I | MICA | plate | face 10 | |

*NEF = non-electroconductive filler
**d50 = mean spherical equivalent particle diameter Sources of Non-Electroconductive Filler GLASS A2900 Potters Industries Inc., Parsipanny, N.J.

NYAD G Nyco Minerals, Inc., Willsboro, N.Y.

GLASS A6000 Potters Industries Inc., Parsipanny, N.J.

MICA Franklin Minerals, Hartwell, Ga.

TABLE 4

| Example Number | Log SER | Log TPVER | Log IPVER |
|---|---|---|---|
| 6 | 5.5 | 7.5 | 5.3 |
| 7 | 6 | 7.5 | 5.4 |
| H | 12 | NM | NM |
| I | 11 | NM | NM |

NM=Not Measured

Log SER=Logarithm of Surface Electrical Resistance

Log TPVER=Log of Through-Plane Volume Electrical Resistivity

Log IPVER=Log of In-Plane Volume Electrical Resistivity

EXAMPLE 8

The following components were fed to a Haake 60 cc. twin screw mixer and compounded at a melt set point of 220° C. and 50 rpm for a total of 11 minutes. 51 g of an ethylene methacrylic acid copolymer (also known as an ionomer) (NUCREL 960) supplied by E. I. du Pont de Nemours and Company, Wilmington, Del., 27 g of an electroconductive powder (ECP-1410-T, antimony-doped tin oxide coated titanium dioxide particles) supplied by E. I. du Pont de Nemours and Company, Wilmington, Del., and 21 g of NYADG Wollastonite rods, length 100–350 microns, supplied by NYCO Minerals Inc., Willsboro, N.Y. The compounded mixture was compression molded at 220° C. using a 0.16 cm (1/16 inch) chase to form a plastic sheet with a thickness of 1.57 mm (62 mils).

Surface electrical resistivity of the molded sheet measured using a Model 262A surface resistivity meter supplied by Monroe Electronics Inc., Lyndonville, N.Y., was found to be $10^7$ ohms/square, corresponding to a Log surface electrical conductivity of 7. The surface had excellent conductivity to effectively dissipate surface static charge.

COMPARATIVE EXAMPLE J

This comparative example was conducted as described in Example I with the difference that a non-electroconductive component was not used. 70 g of NUCREL 960 pellets and 30 g of ECP-1410-T powder were compounded and compression molded using a 220° C. melt set point and 150 rpm for a total of 11 minutes. The ECP-1410-T component was 30% by weight of the composition compared with 27.3% by weight in Example 1 which contained wollastonite in addition. Even though the proportion of electroconductive filler in the composition was higher the surface electrical resistivity of the molded sheet, measured as above, was $10^{12}$ ohms/square, corresponding to a Log surface electrical conductivity of 12.

The surface conductivity of this composition was much lower than that of the composition made in Example 8 and it was not static-dissipative. The difference between the compositions of Example 8 and Comparative Example J clearly demonstrated that more efficient utilization of the electroconductive filler occurred when a non-electroconductive filler was incorporated.

What is claimed is:

1. A static dissipative bulk polymeric composition comprising a thermoplastic or thermosetting polymer matrix having a substantially uniform distribution therein of at least two fillers, wherein at least one filler comprises electroconductive doped-$SnO_2$ particles, and at least one filler comprises non-electroconductive particles having at least one dimension of at least about 30 microns, said matrix subjected to extrusion, melt processing or injection molding.

2. The composition of claim 1 wherein the polymer matrix is from about 50% to about 95% by volume, the electroconductive filler is from 5% to about 30% by volume and the non-electroconductive filler is from about 5% to about 30% by volume, said percentages totaling 100%.

3. The composition of claim 1 wherein the polymer matrix is from about 40% to about 90% by weight, the electroconductive filler is from about 5% to about 50% by weight, and the non-electroconductive filler is from about 5% to about 30% by weight, said percentages totaling 100%.

4. The composition of claim 1 wherein the electroconductive filler is selected from the group consisting of a) crystals or powders of X-$SnO_2$, b) uniformly distributed crystallites of X-$SnO_2$ and silica, and c) two-dimensional networks of X-$SnO_2$ crystallites coating at least one core particle, wherein X is Sb, Ta, P, In, Al, Mo, W, F or Cl, and the weight percentage of X as a fraction of X-$SnO_2$ is from about 0.01% to about 50%, and wherein said core particle is selected from the group consisting of mica, titanium dioxide, silica, hollow silica shells, barium sulfate, aluminum borate, fibrous potassium titanate, mineral wool, inorganic silicates, clay, and asbestos.

5. The composition of claim 1 wherein the non-electroconductive filler particles are selected from the group consisting of glass rods, glass spheres, hollow glass spheres, mineral wool, wollastonite, cordierite, anorthite, pyrophyllite and calcium sulfate fibers wherein said particles have at least one dimension in the size range of from about 30 to about 500 microns.

6. The composition of claim 1 wherein the polymer matrix is selected from the group consisting of polyesters, polyester elastomers, polyether-ester block copolymers, polyolefins, polyolefin copolymers, polyolefin terephthalates, polyethylene terephthalate glycol, ethylene methacrylic acid copolymers, ionomer resins, ester urethanes, ether urethanes, chain extended polyoxiranes and mixtures thereof.

7. The composition of claim 1 wherein the electroconductive filler is X-$SnO_2$ on titanium wherein X is Sb, the non-electroconductive filler is glass spheres or wollastonite, having one dimension greater than 30 microns, and the polymer matrix is a polyether-ester block copolymer.

8. The composition of claim 1 wherein the electroconductive filler is X-$SnO_2$ on mica wherein X is Sb, the non-electroconductive filler is glass spheres or wollastonite, having one dimension greater than 30 microns, and the polymer matrix is a polyether-ester block copolymer.

9. A composition of claim 1 wherein the surface electrical resistivity is in the range of from $10^3$ to $10^{11}$ ohms per square.

10. A composition of claim 1 wherein the surface electrical resistivity is in the range of from $10^5$ to $10^9$ ohms/square per square.

* * * * *